US008826780B1

(12) United States Patent
Alho et al.

(10) Patent No.: US 8,826,780 B1
(45) Date of Patent: Sep. 9, 2014

(54) SOCKET TOOL FOR USE WITH FUEL AND OIL FILTER CAPS

(75) Inventors: Timothy J. Alho, Pleasant Prairie, WI (US); Maximillian N. Knoell, Racine, WI (US)

(73) Assignee: A&E Incorporated, Racine, WI (US)

( * ) Notice: Subject to any disclaimer, the term of this patent is extended or adjusted under 35 U.S.C. 154(b) by 227 days.

(21) Appl. No.: 13/292,589

(22) Filed: Nov. 9, 2011

(51) Int. Cl.
*B25B 13/50* (2006.01)
*B25B 13/06* (2006.01)

(52) U.S. Cl.
USPC ..... 81/176.15; 81/124.2; 81/124.6

(58) Field of Classification Search
USPC ..... 81/177.15, 176.2, 124.2, 124.6, 176.15
See application file for complete search history.

(56) References Cited

U.S. PATENT DOCUMENTS

| | | | | |
|---|---|---|---|---|
| 2,405,462 | A * | 8/1946 | Stair | 81/124.7 |
| 5,862,721 | A | 1/1999 | Kowats | |
| 6,082,230 | A | 7/2000 | Steinweb | |
| 6,401,575 | B1 * | 6/2002 | Shively et al. | 81/176.15 |
| 6,564,679 | B1 | 5/2003 | Llamas et al. | |
| 6,779,424 | B2 * | 8/2004 | Schmidt | 81/176.15 |
| 2008/0006127 | A1 * | 1/2008 | Marasco | 81/124.2 |
| 2009/0301269 | A1 * | 12/2009 | Wedge | 81/124.2 |

* cited by examiner

*Primary Examiner* — Hadi Shakeri
(74) *Attorney, Agent, or Firm* — Ryan Kromholz & Manion, S.C.

(57) ABSTRACT

A tool adapted to be used with a filter cap having an engagement structure includes a body having an upper end and a side wall extending from the upper end and terminating in a lower open end. The side wall is formed with a plurality of notches extending upwardly from the lower open end and adapted to receive the engagement structure of the filter cap. The notches define a set of spaced apart engaging members which form a driven head receiving structure adapted to matingly and non-rotatably receive the engagement structure of the filter cap. The body is engagably disposed over the engagement structure, and the body together with the filter cap is rotated in a clockwise or counterclockwise direction.

9 Claims, 8 Drawing Sheets

SOCKET TOOL FOR USE WITH FUEL AND OIL FILTER CAPS

FIELD OF THE INVENTION

The present disclosure relates generally to a tool for removal and installation of filter caps, such as fuel filter and oil filter caps. More particularly, the present disclosure pertains to a socket tool for use with filter caps of varying structural design.

BACKGROUND OF THE INVENTION

Vehicles commonly employ fuel and oil filter assemblies which must be serviced after the engine is run for a predetermined number of miles. Each filter assembly typically includes a canister for housing the filter, and a filter cap which is screwthreadedly attached to the canister so that it can be periodically removed to service the filter.

Certain filter assemblies have filter caps with various constructions which necessitate the use of different individual tools to effect removal and replacement of the filter cap.

There is a need for a simple, versatile tool which can be used to remove and install filter caps of varying sizes and configurations.

SUMMARY OF THE INVENTION

It is object of the present disclosure to provide a simple and versatile tool which can be implemented to remove and install differently constructed fuel and oil filter caps.

The present disclosure relates to a tool for use in combination with a filter cap having at least one of a radially extending ribbed engagement structure and a driven head engagement structure formed on an upper surface area. The tool includes a body having an upper end and a side wall extending from the upper end and terminating in a lower open end. The upper end is formed with a drive structure thereon. The side wall is formed with a plurality of notches extending upwardly from the lower open end for receiving the ribbed engagement structure. The notches define a set of engaging members, each of which include an outer surface defined by the side wall, an inner engagement surface, and a pair of opposed side surfaces. The side surfaces of adjacent engaging members are parallel to one another, and the inner surfaces of the engaging members form a receiving structure for matingly and non-rotatably receiving the driven head engagement structure. The body is engagably disposed over at least one of the ribbed engagement structure and the driven head engagement structure of the filter cap, and the body together with the filter cap is rotated in a clockwise or counterclockwise direction.

In the preferred embodiment, the upper end has a thickness defined by a distance between a flat top wall and a flat bottom wall. The upper end is open at a center thereof and has a square bore which extends through the top wall and the bottom wall. The body has a generally cylindrical configuration having a hollow interior. The notches extend upwardly from the lower open end to an annular wall that projects beyond the bottom wall. The body is formed preferably with six notches and six engaging members, each of the notches and engaging members being spaced equidistantly apart. Each engaging member terminates at a curved segment of the lower open end which curved segment is beveled outwardly and chamfered inwardly. The receiving structure formed by the engaging members has a hex head configuration.

BRIEF DESCRIPTION OF THE DRAWINGS

The drawings illustrate the best mode presently contemplated in carrying out the disclosure.

In the drawings.

DETAILED DESCRIPTION

Figure 1:
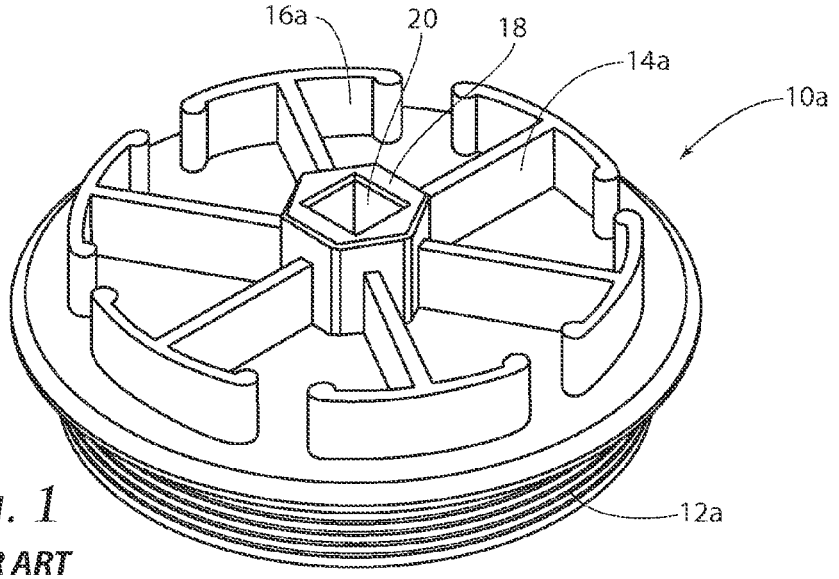
Fig. 1 PRIOR ART
FIG. 1 is a top perspective view of one embodiment of a fuel filter cap adapted to be used on a filter housing.

Referring now to the drawings, FIGS. 1-6 illustrate several embodiments of differently constructed filter caps 10*a*, 10*b*, 10*c* adapted to be removably mounted on upper ends of fuel or oil filter canisters used on certain vehicles. Each of the filter caps 10*a*, 10*b*, 10*c* is circular and commonly includes a threaded lower edge 12*a*, 12*b*, 12*c*, respectively, designed to cooperate with threads formed on the particular filter canister.

Figure 2:
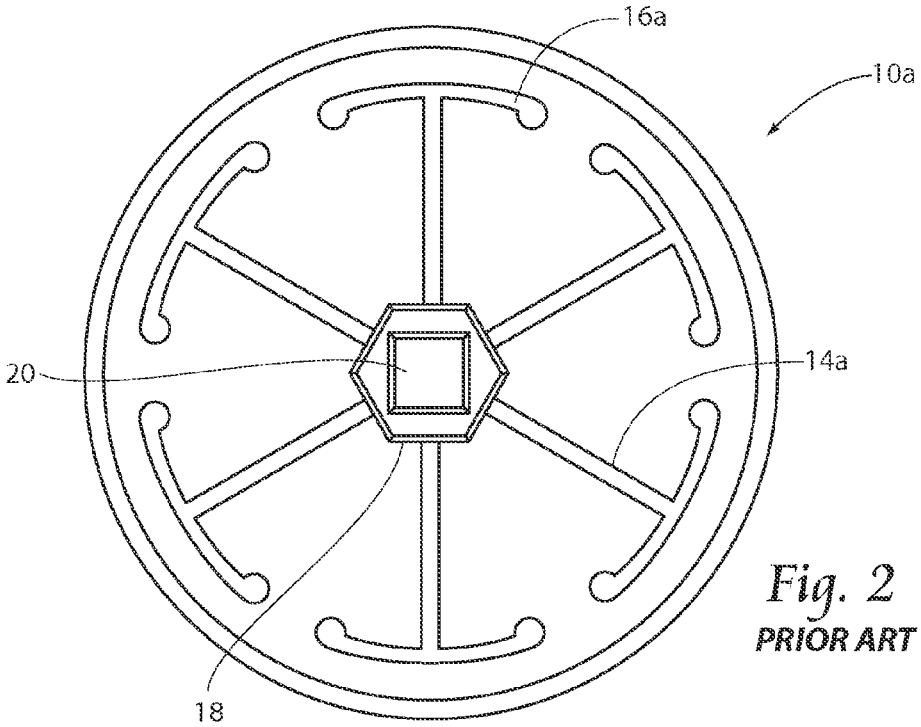
Fig. 2 PRIOR ART
FIG. 2 is a top view of FIG. 1.

FIGS. 1 and 2 show a first embodiment of a filter cap 10*a* having an upper end formed with a plurality of six spaced apart, elongate ribs 14*a* extending radially thereon from a center of the cap 10*a*. Each rib 14*a* is positioned at an angle of 60° from an adjacent rib 14*a*, and is joined at an outer end to a circumferential wall segment 16*a* formed near an outer edge at the top of filter cap 10*a*. An inner end of each rib 14*a* is fixed to a hex head socket 18 provided with a square shaped recess 20 for receiving a suitable drive member normally used to rotate the filter cap 10*a*.

Figure 3:
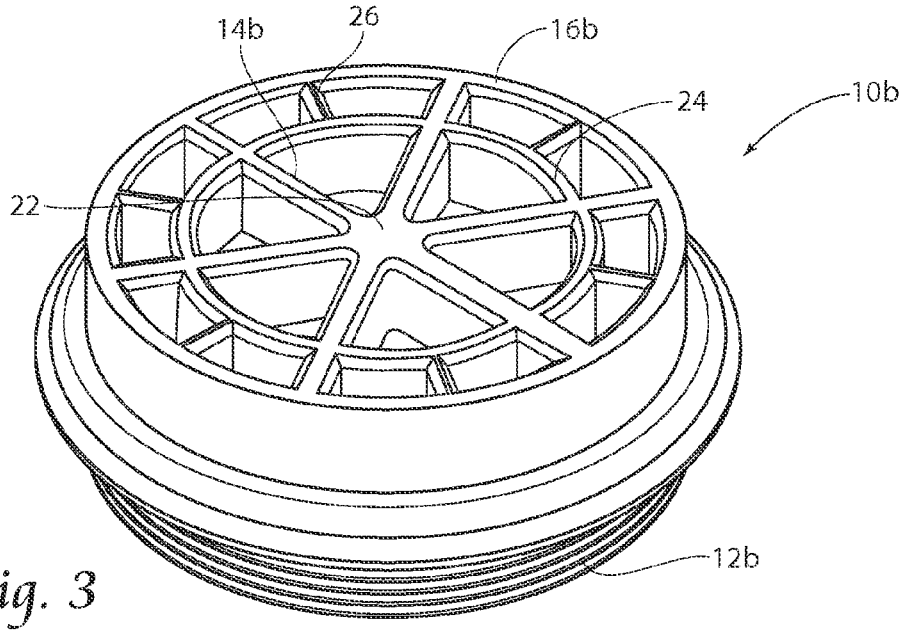
Fig. 3 PRIOR ART
FIG. 3 is a top perspective view of a second embodiment of a fuel filter cap adapted to be used on a filter housing.
Figure 4:
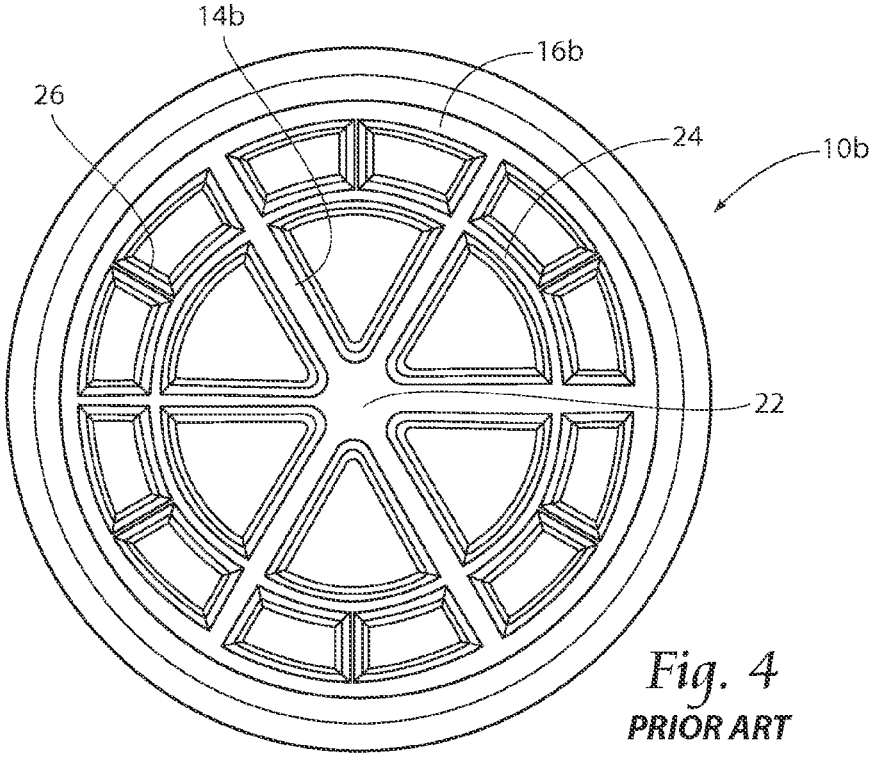
Fig. 4 PRIOR ART
FIG. 4 is a top view of FIG. 3.

FIGS. 3 and 4 show a second embodiment of a filter cap 10*b* having an upper end formed with a plurality of six spaced apart, elongate ribs 14*b* extending radially from a center hub 22 of cap 10*b*. Each rib 14*b* is again positioned at an angle of 60° from adjacent rib 10*b*, and is joined at an outer end to a continuous circumferential wall 16*b* formed near the edge of the top of filter cap 10*b*. The ribs 14*b* pass through a circular inner wall 24 which is formed concentric with wall 16*b*, and reinforcing walls 26 extend between the walls 16*b* and 24. As is known, a pair of ribs 14*b* is designed to be engaged by notches on dependent legs of a known commercially available U-shaped tool which is used to rotate the cap 10*b*.

Figure 5:
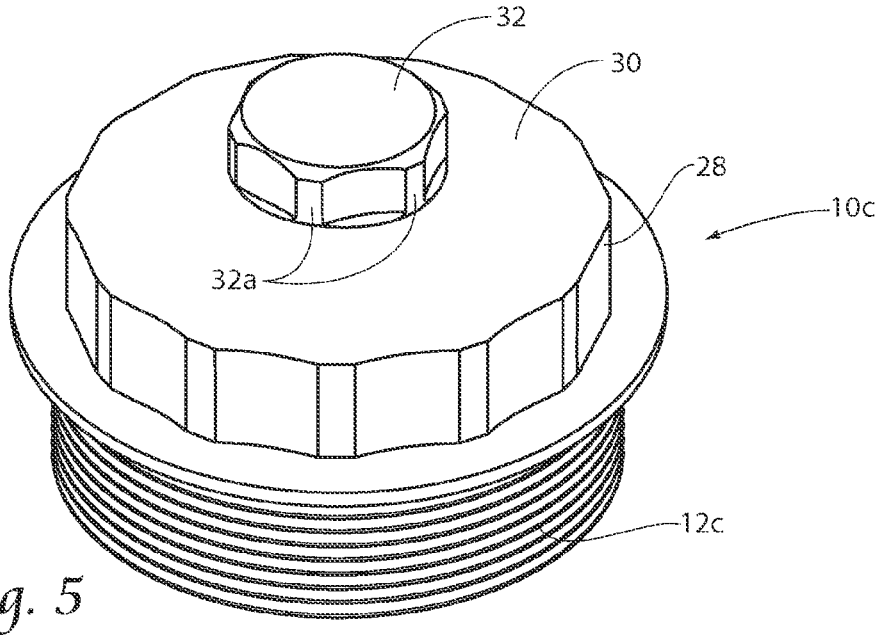
Fig. 5 PRIOR ART
FIG. 5 is a top perspective view of a third embodiment of a fuel filter cap adapted to be used on a filter housing.
Figure 6:
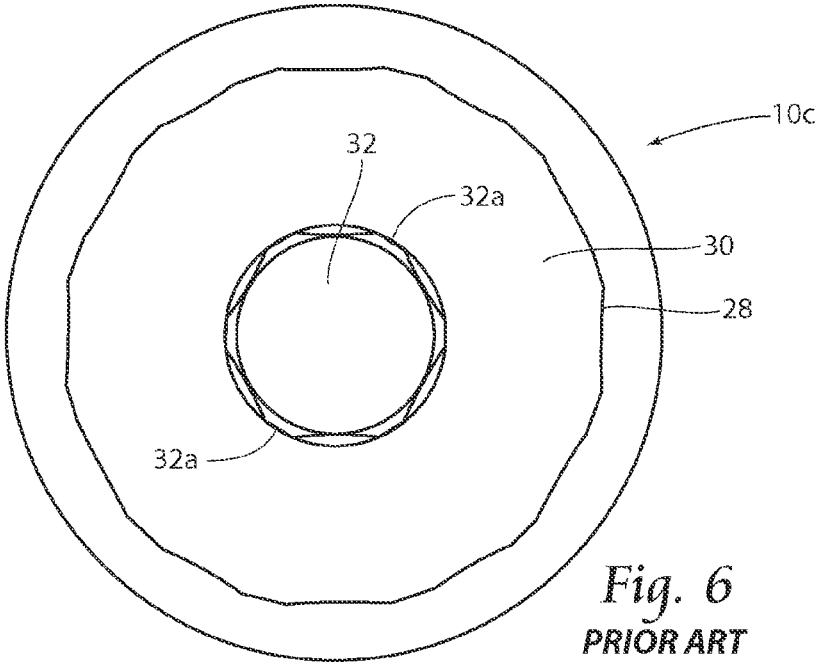
Fig. 6 PRIOR ART
FIG. 6 is a top view of FIG. 5.
Figure 11:
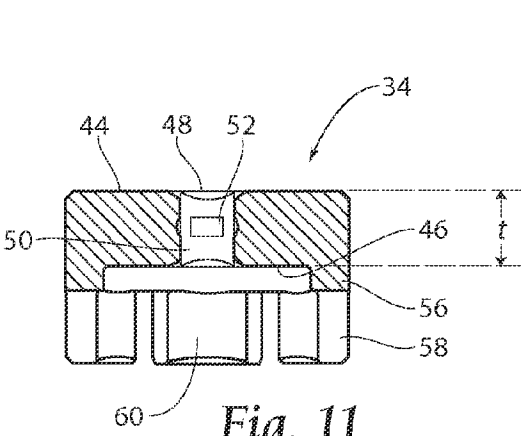
FIG. 11 is a sectional view taken on line 11-11 of FIG. 8.
Figure 9:
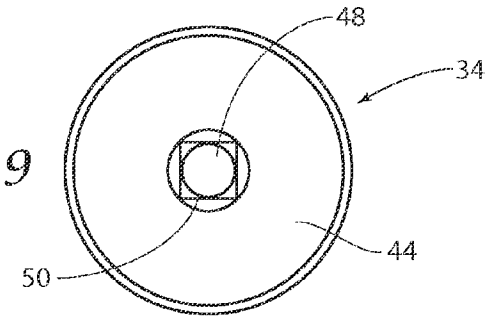
FIG. 9 is a top view of FIG. 8.
Figure 8:
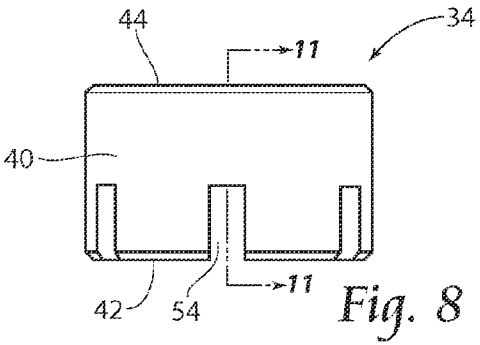
FIG. 8 is an elevational view of the socket tool shown in FIG. 7.
Figure 10:
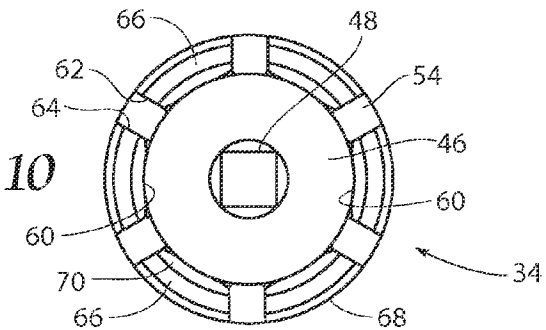
FIG. 10 is a bottom view of FIG. 8.
Figure 7:
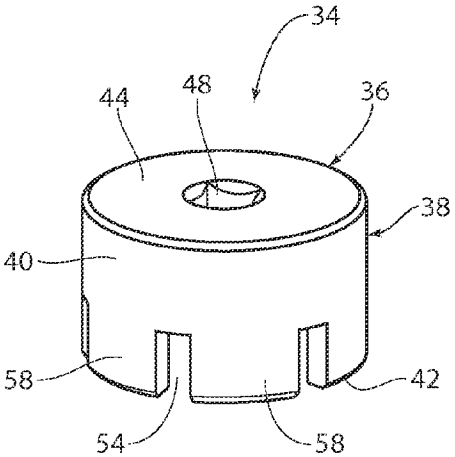
FIG. 7 is a top perspective view of a socket tool used to remove and install the filter caps shown in FIGS. 1-6 in accordance with the present disclosure.

FIGS. 5 and 6 show a third embodiment of a filter cap 10*c* having an upper end formed with a non-circular raised portion 28 which extends upwardly from an upper end of cap 10*c*. A top flat surface 30 of the raised portion 28 is provided with a hexagonal head 32 having outermost faces 32*a* which are engageable with a suitable driving tool to rotate the cap 10*c*.

In accordance with the present disclosure, there is provided a socket tool 34 which is conveniently designed to be used in the removal and installation of each of the various filters cap 10*a*, 10*b*, 10*c* as described above.

Referring now to FIGS. 7-13, the socket tool 34 is comprised of a rigid body 36 having a generally cylindrical configuration with a hollow interior. The body 36 is formed by an upper open end 38 and a rounded side wall 40 terminating in a lower open end 42. The open upper end 38 has a thickness t (FIG. 11) defined by the distance between a circular flat top wall 44 and a circular flat bottom wall 46. The top wall 44 lies external to the body 36 and the bottom wall 46 is located internally of the body 36. A drive structure in the form of a square bore 48 is centrally disposed within the upper end 38, and extends through the top and bottom walls 44, 46, respectively. The square bore 48 is configured to matingly receive a tang of a drive member, such as a ratchet wrench, which is used to rotate the socket tool 34 when the latter is positioned upon the filter cap 10*a*, 10*b*, 10*c* to be removed or installed. Side walls 50 forming the square bore 48 are provided with indentations 52 which normally receive external nibs on the tang to maximize the mating fit between the tang and side walls 50 of the square bore 48.

Figure 12:
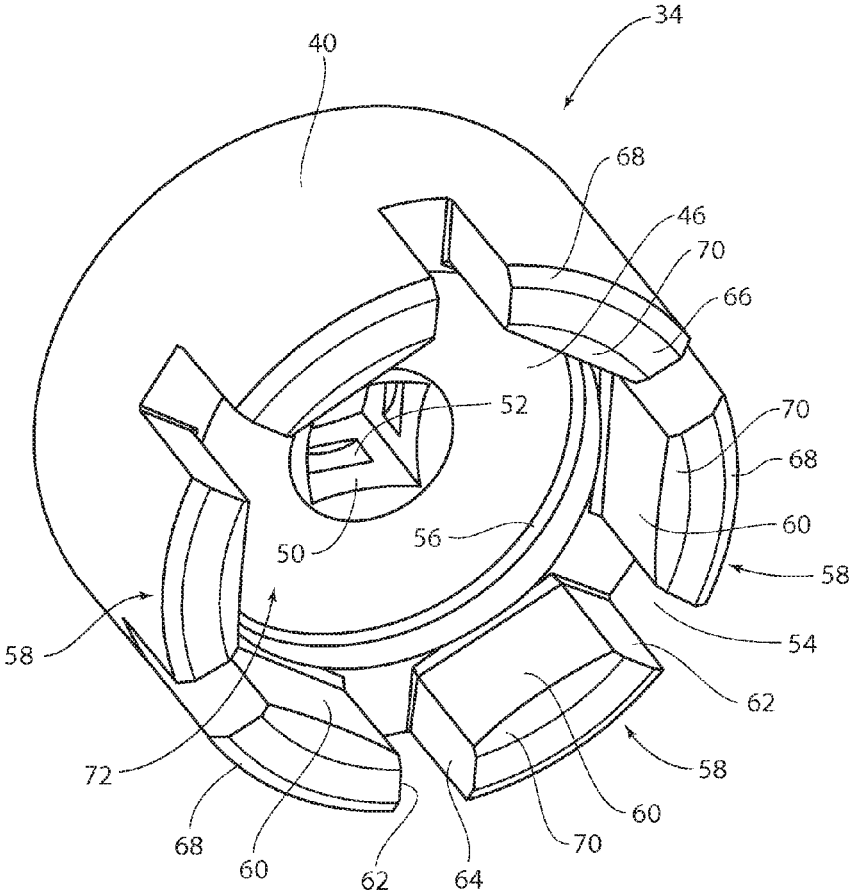
FIG. 12 is a bottom perspective view of the socket tool shown in FIG. 7.
Figure 13:
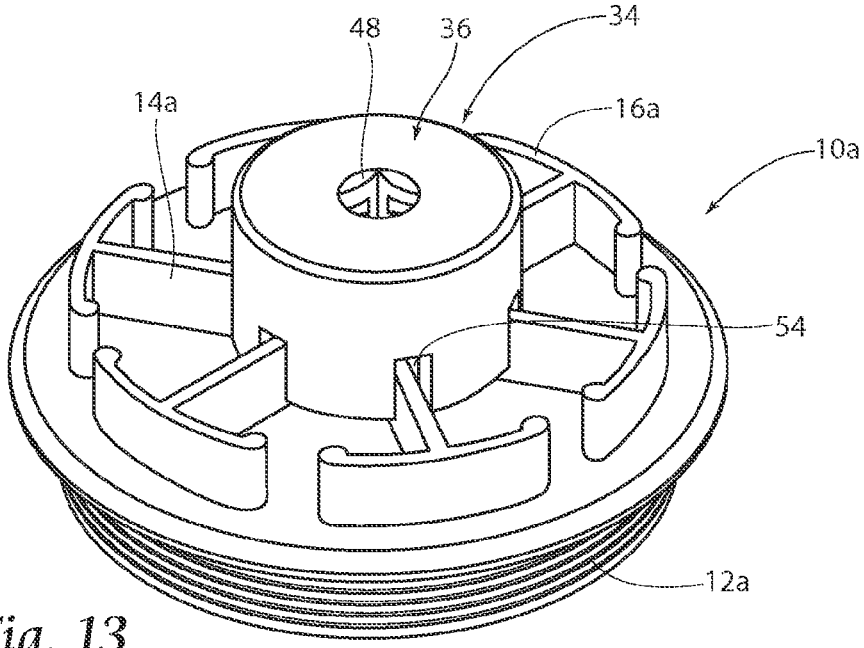
FIG. 13 is a top perspective view of the socket tool positioned on the filter cap of FIG. 1.

The side wall 40 of the socket tool 34 includes a plurality (i.e. six) of notches 54 which extend upwardly from the lower open end 42 to an annular wall 56 that projects beyond the bottom wall 46. The number of notches 54 preferably equals the number of radial ribs 14*a*, 14*b* on the filter caps 10*a*, 10*b*, respectively. The notches 54 are equally spaced apart around the lower periphery of the side wall 40, and define a set of six engaging members 58 which are also spaced equally apart. Each of the engaging members 58 commonly includes a curved outer surface defined by the side wall 40, a flat inner engagement surface 60 and a pair of flat opposed side surfaces 62, 64. Side surfaces 62, 64 of adjacent engaging members 58 are parallel to one another. Each engaging member 58 terminates at a curved segment 66 of the lower end 42 which is beveled outwardly at 68 and chamfered inwardly at 70. As best seen in FIG. 12, the body 36 has an internal cavity 72 for matingly receiving the hexagonal head 32 of the filter cap 10*c*. The spaced apart flat inner surfaces 60 of the tool 34 define a hex head receiving structure.

Figure 14:
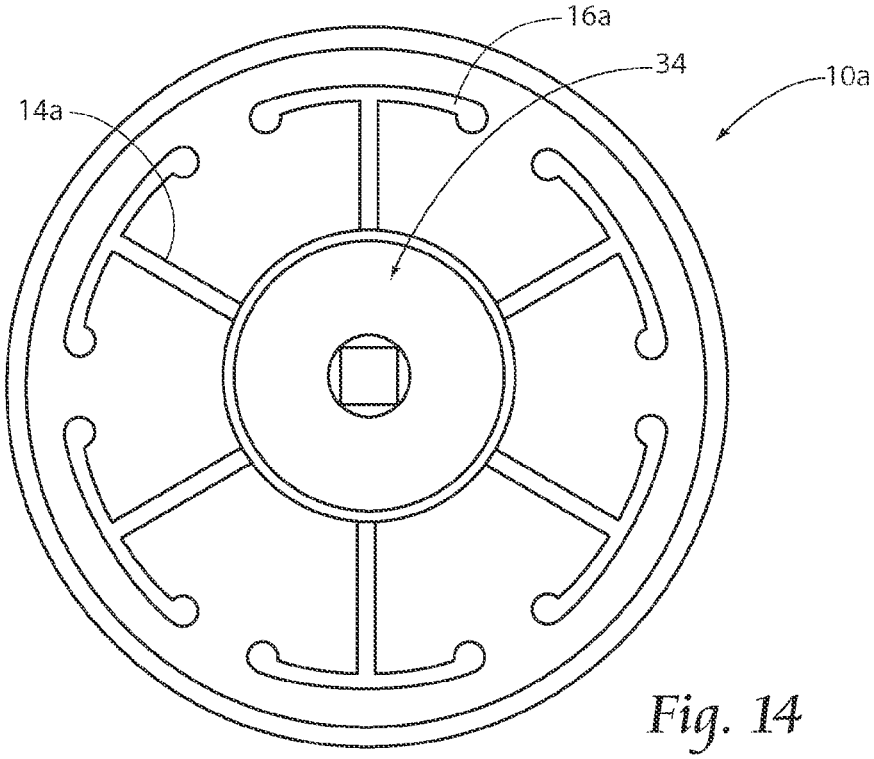
FIG. 14 is a top view of FIG. 13.
Figure 15:
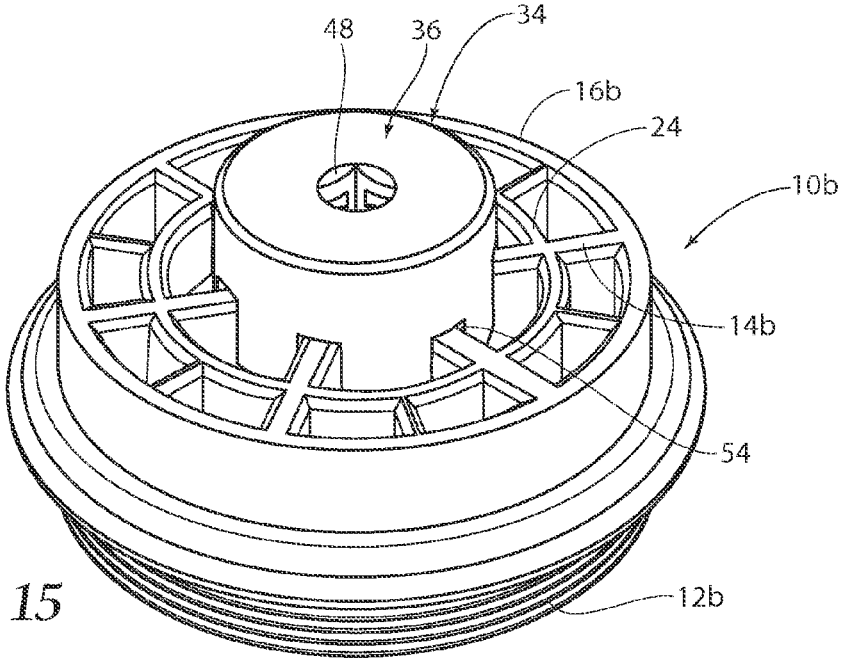
FIG. 15 is a top perspective view of the socket tool positioned on the filter cap of FIG. 3.
Figure 16:
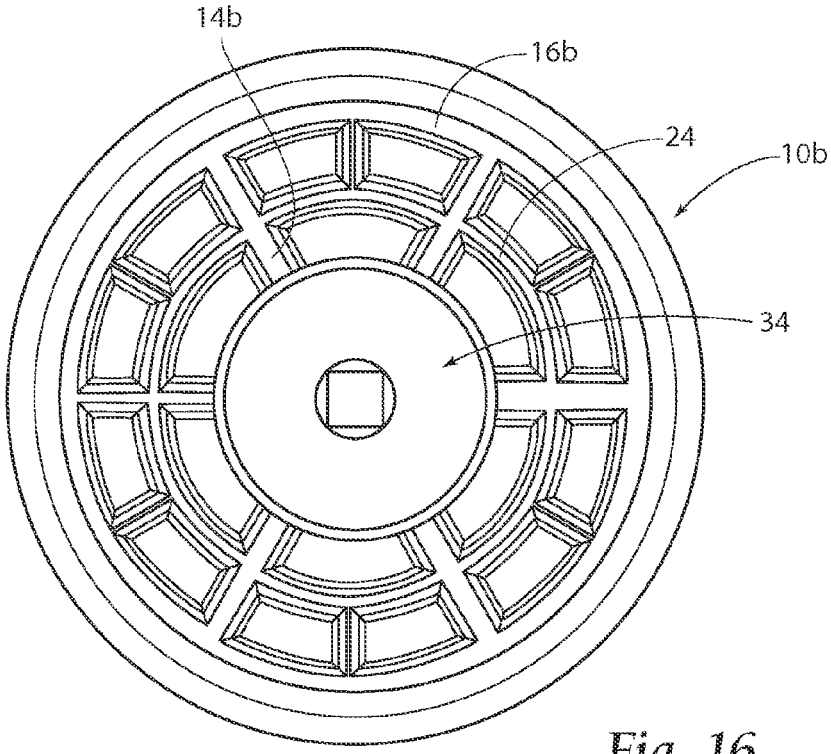
FIG. 16 is a top view of FIG. 15.
Figure 17:
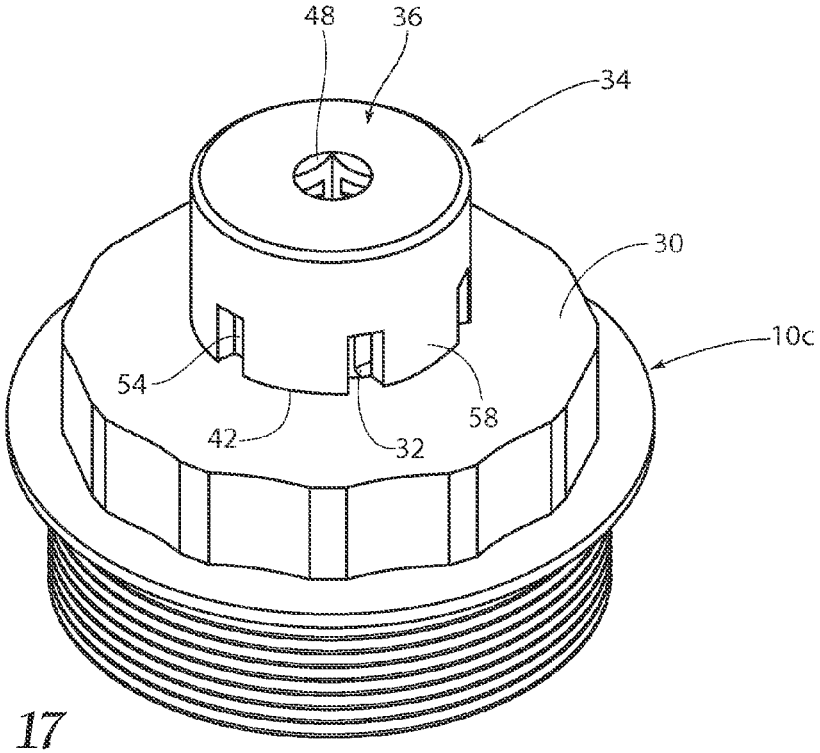
FIG. 17 is a top perspective view of the socket tool positioned on the filter cap of FIG. 5.
Figure 18:
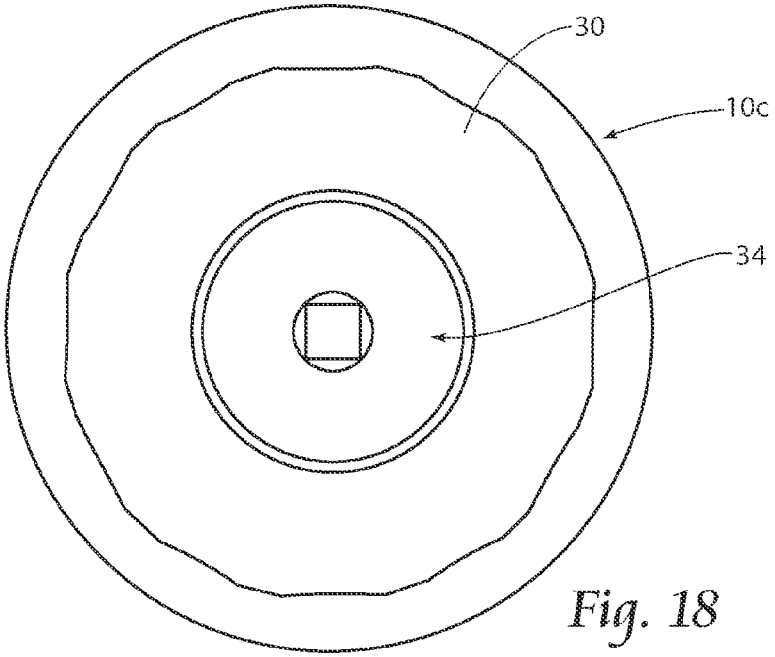
FIG. 18 is a top view of FIG. 17.

The tool 34 is used by disposing the body 36 over the center of either of the caps 10*a* or 10*b* such that the notches 54 on the side wall 40 straddle the ribs 14*a* (FIG. 13-14) or 14*b* (FIGS. 15-16). When using the cap 10*c*, the tool 34 is placed over the hexagonal head 32 such that the lower end 42 rests on the top flat surface 30, and the outermost faces 32*a* frictionally, matingly and non-rotatably engage the receiving structure defined by the inner surfaces 60 of the engaging members 58. Once the socket tool 34 is positioned over the ribs 14*a*, 14*b* of caps 10*a*, 10*b*, or the hexagonal head 32 of cap 10*c*, a drive member, such as a ratchet wrench, with a square tang is matingly disposed in the square bore 48 formed at the top of the cap 10*a*, 10*b* or 10*c*. The drive member is then turned in a clockwise or counterclockwise direction to simultaneously rotate the tool 34 and the engaged cap 10*a*, 10*b* or 10*c* so as to remove or install the cap 10*a*, 10*b*, or 10*c* relative to its canister.

It should be appreciated that the ribs 14*a* or 14*b* and the hexagonal head 32 collectively define a raised engagement structure that rises upwardly on the upper ends of the caps 10*a*, 10*b*, 10*c*, and is engagable with the tool 34.

Various alternatives are contemplated as being within the scope of the following claims particularly pointing out and distinctly claiming the subject matter regarded as the invention.

What is claimed is:

1. A tool for use in combination with a filter cap having at least one of a radially extending ribbed engagement structure and a driven head engagement structure formed on an upper surface thereof, the tool comprising:

a body having an upper end and a side wall extending from the upper end and terminating in a lower open end, the upper end being formed with a drive structure thereon, a plurality of engaging members each comprising an of surface defined by the side wall, a flat inner engagement surface, a pair of opposed side surfaces, and a curved segment defined by the lower end a beveled edge extending to the outer surface and a chamfered edge extending to flat inner engagement surface;

the side surfaces of adjacent engaging members are parallel and define a plurality of notches extending upwardly from the lower open end, the notches extend from the flat inner engagement surface through the outer surface;

the notches are configured to receive the ribbed engagement structure, and at inner surfaces of the engaging members are configured to matingly and non-rotatably receive the driven head engagement structure; and wherein the body is engagably disposed over at least one of the ribbed engagement structure and the driven head engagement structure of the filter cap, and the body together with the filter cap is rotated in a clockwise or counterclockwise direction.

2. The tool of claim 1, wherein the upper end has a thickness defined by a distance between a flat top wall and a flat bottom wall.

3. The tool of claim 2, wherein a square bore extends through the top wall and the bottom wall.

4. The tool of claim 2, wherein the notches extend upwardly from the lower open end to an annular wall that projects beyond the bottom wall.

5. The tool of claim 1, wherein the upper end is open at a center thereof.

6. The tool of claim 1, wherein the body is formed with six notches and six engaging members, each of the notches and engaging members being spaced equidistantly apart.

7. The tool of claim 1, wherein each engaging member terminates at a curved segment of the lower open end which curved segment is beveled outwardly and chamfered inwardly.

8. The tool of claim 1, wherein the receiving structure has a hex head configuration.

9. A tool configured to be used with a filter cap having an engagement structure formed on an upper surface thereof, the tool comprising:

a body having an upper end and a side wall extending from the upper end and terminating in a lower open end, the upper end being formed with a bore configured to receive a drive member therein, a plurality of engaging members each comprising an outer surface defined by the side wall a flat inner engagement surface, a pair of opposed side surfaces, and a curved segment defined by the lower end with a beveled edge extending to the outer surface and a chamfered edge extending to the flat inner engagement surface;

the side surfaces of adjacent engaging members are parallel and define a plurality of notches extending upwardly from the lower open end, the notches extend from the flat inner engagement surface through the outer surface;

the notches are configured to receive the engagement structure of the filter cap, and the flat inner surfaces of the engaging members form a driven head receiving structure configured to matingly and non-rotatably receive the engagement structure of the filter cap.

* * * * *

UNITED STATES PATENT AND TRADEMARK OFFICE

CERTIFICATE OF CORRECTION

PATENT NO. : 8,826,780 B1
APPLICATION NO. : 13/292589
DATED : September 9, 2014
INVENTOR(S) : Alho et al.

It is certified that error appears in the above-identified patent and that said Letters Patent is hereby corrected as shown below:

On the title page item [75] Inventors delete "Maximillian N. Knoell" and insert -- Maximilian N. Knoell --

In the Claims

Column 4, line 8 claim 1, after "comprising an" delete "of" and insert -- outer --

Column 4, line 11 claim 1, after "by the lower end" insert -- with --

Column 4, line 20 claim 1, after "structure, and" delete "at" and insert -- the flat --

Column 4, line 56 claim 9, after "the side wall" insert -- , --

Signed and Sealed this
Seventeenth Day of February, 2015

Michelle K. Lee

Michelle K. Lee
*Deputy Director of the United States Patent and Trademark Office*